United States Patent [19]

Schlüter

[11] 4,149,681

[45] Apr. 17, 1979

[54] APPARATUS FOR RELEASABLY SUPPORTING BOBBINS OF WEB MATERIAL

[75] Inventor: Karl-Heinz Schlüter, Hamburg, Fed. Rep. of Germany

[73] Assignee: Hauni-Werke Körber & Co. KG., Hamburg, Fed. Rep. of Germany

[21] Appl. No.: 906,754

[22] Filed: May 17, 1978

[30] Foreign Application Priority Data

May 27, 1977 [DE] Fed. Rep. of Germany ..... 2724024

[51] Int. Cl.[2] ..... B65H 19/02

[52] U.S. Cl. ..... 242/68.3

[58] Field of Search ..... 242/68.3, 68.1, 68.2, 242/72 R, 72 B, 72.1; 279/2 R, 2 A; 269/48.1

[56] References Cited

U.S. PATENT DOCUMENTS

| | | | |
|---|---|---|---|
| 3,690,581 | 9/1972 | Wainio | 242/68.3 |
| 3,801,033 | 4/1974 | Sanderson | 242/68.3 |
| 3,833,181 | 9/1974 | Watkins | 242/68.3 |

*Primary Examiner*—Harvey C. Hornsby
*Assistant Examiner*—John M. Jillions
*Attorney, Agent, or Firm*—Peter K. Kontler

[57] ABSTRACT

Apparatus for releasably supporting the core of a bobbin of cigarette paper web has a rotary holder which carries a spindle and has a flange extending beyond the spindle to locate one axial end of the core on the spindle. The spindle has apertures for the fingers of a first locating device which is mounted on the holder and engages the internal surface of the core to center the bobbin on the spindle, and for the fingers of a second locating device which is also mounted on the holder and engages one axial end of the core to urge the other axial end of the core against the flange. A ring-shaped actuating element is reciprocable on the holder in the axial direction of the spindle to disengage the fingers of the first locating device prior to disengagement of the fingers of the second locating device or to engage the fingers of the second locating device ahead of the fingers of the first locating device. The fingers are urged against the core by springs which are mounted and dimensioned in such a way that the force with which the fingers of the second locating device engage the core is smaller than the force with which the core is engaged from within by the fingers of the first locating device. This enables the first locating device to center the core while the latter is already biased against the flange. A motor is employed to move the actuating element in a direction to retract the fingers into the spindle and to thus allow for rapid replacement of the bobbin with a fresh bobbin.

16 Claims, 2 Drawing Figures

APPARATUS FOR RELEASABLY SUPPORTING BOBBINS OF WEB MATERIAL

BACKGROUND OF THE INVENTION

The present invention relates to apparatus for releasably supporting annular members, especially for locating and releasably supporting hollow cylindrical cores of bobbins or reels for web material, such as cigarette paper or the like. More particularly, the invention relates to improvements in apparatus or devices wherein the annular core of a bobbin is slipped onto a rotary spindle or hub preparatory to winding web material onto or withdrawing web material from the core. The invention will be described with reference to apparatus for supporting bobbins of cigarette paper or other web material which is utilized in the tobacco processing industry with the understanding, however, that the apparatus can be used with equal advantage for releasably supporting bobbins of web material which is intended for other uses.

A bobbin of cigarette paper is normally mounted on a carrier which can support several bobbins at a time, especially an expiring bobbin and a fresh bobbin which latter is held in a position of readiness for splicing its web to the running web when the supply of running web on the expiring bobbin is nearly exhausted. As a rule, the annular core of the bobbin is urged against a stop so that it is properly located in the axial position thereof. It is also known to employ spring-biased fingers which urge the core axially against the stop. Reference may be had to U.S. Pat. No. 3,463,519 granted Aug. 26, 1969 to Raymond. The patented apparatus employs three fingers which urge the core against the flange of a rotary hub. The outer diameter of the hub is selected in such a way that it matches the inner diameter of the core.

It has been found that conventional apparatus fail to satisfy all requirements for adequate positioning of a bobbin in such a way that the bobbin is properly located during withdrawal of web material and can be rapidly removed from the spindle when the supply of cigarette paper is exhausted. This also applies for bobbins which store supplies of other types of web material. First of all, it is important to properly center the core of the bobbin on the spindle, regardless of whether or not the outer diameter of the spindle matches the inner diameter of the core. Secondly, the core must be held against axial movements. Such requisites must be met in order to prevent radial and/or axial wobbling of the bobbin during withdrawal of web material. Furthermore, the bobbin must be located and held with a certain force which insures that its core does not slip on the spindle when the latter is decelerated preparatory to replacement of the bobbin. Apparatus for releasably supporting bobbins of cigarette paper or the like are equipped with brakes which maintain the web under tension during withdrawal from the bobbin and insure that the bobbin is rapidly decelerated to zero speed as soon as the tensional stress upon the web decreases to zero. An additional requisite which must be satisfied by such apparatus is that an expired bobbin should be readily removable from the spindle in order to provide room for mounting of a fresh bobbin. This is particularly important in cigarette makers which turn out at least 4,000 cigarettes per minute and wherein the supply of cigarette paper on a fresh bobbin is exhausted within a short interval of time, i.e., the attendant must rapidly replace the expired bobbin with a fresh bobbin during the interval of withdrawal of web material from the expiring bobbin. Finally, an exhausted bobbin should be removable from and a fresh bobbin should be insertable into the apparatus with a minimum of effort because such operation must be carried out at frequent intervals and a fresh bobbin of cigarette paper is a rather heavy and bulky commodity. As mentioned above, heretofore known apparatus fail to meet all or even the majority of the above-enumerated requirements.

OBJECTS AND SUMMARY OF THE INVENTION

An object of the invention is to provide a bobbin supporting and locating apparatus which insures that each and every bobbin is properly positioned thereon regardless of eventual differences between the dimensions of cores of successively mounted bobbins.

Another object of the invention is to provide the apparatus with novel and improved means for accurately centering the core of a bobbin in the radial direction while simultaneously insuring predictable positioning of the core in the axial direction of the spindle, or vice versa.

A further object of the invention is to provide an apparatus which allows for rapid and effortless replacement of exhausted bobbins with fresh bobbins.

An additional object of the invention is to provide the apparatus with novel and improved means for controlling the sequence in which the moving parts of the apparatus engage or release the core of a bobbin on the spindle.

Still another object of the invention is to provide the apparatus with novel and improved locating devices for radial and axial positioning of a core on the spindle.

An ancillary object of the invention is to provide a machine, especially a machine for the manufacture and/or processing of rod-shaped articles which constitute or form part of smokers' products, which embodies one or more apparatus of the above outlined character.

The invention is embodied in an apparatus for releasably clamping an annular article, particularly the cylindrical core of a bobbin of web material which latter may constitute cigarette paper, imitation cork, reconstituted tobacco, strip material which is to be converted into uniting bands for connection of filter plugs to plain cigarettes, or the like. The apparatus comprises a holder (e.g., a sleeve which is rotatably mounted on the shaft of a pivotable carrier in a cigarette maker), a spindle or hub which is rotatably mounted on or rotates with the holder and is arranged to extend through the central opening of an article thereon, a stop (e.g., a flange of the aforementioned sleeve-like holder) extending radially beyond the spindle to constitute an abutment for one end of an article on the spindle, first locating means provided on the holder and movable to and from a position of engagement with the other end of the article on the spindle so as to maintain the one end of the article in contact with the stop, second locating means provided in the spindle and being movable to and from a position of engagement with the internal surface of an article on the spindle to center the article in the radial direction of the spindle, biasing means (e.g., two sets of helical springs) for urging one of the locating means against the article on the spindle with a first force when the one locating means (e.g., the first locating means) assumes the aforementioned position of engagement with the other end or with the internal surface of the article on the spindle and for urging the other locating means against the article with a greater second force when the other locating means assumes the aforementioned position of engagement with the internal surface or with the other end of the article on the spindle, and control means including actuating means which is operative (e.g., in response to starting or stoppage of a motor) to effect the movement of the one locating means to the respective position ahead of the other locating means. Such sequencing of movements of the locating means into engagement with the article insures that the other locating means can effect the necessary adjustment of the position of the article with respect to the spindle in spite of the fact that the article is already engaged and biased by the one locating means.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
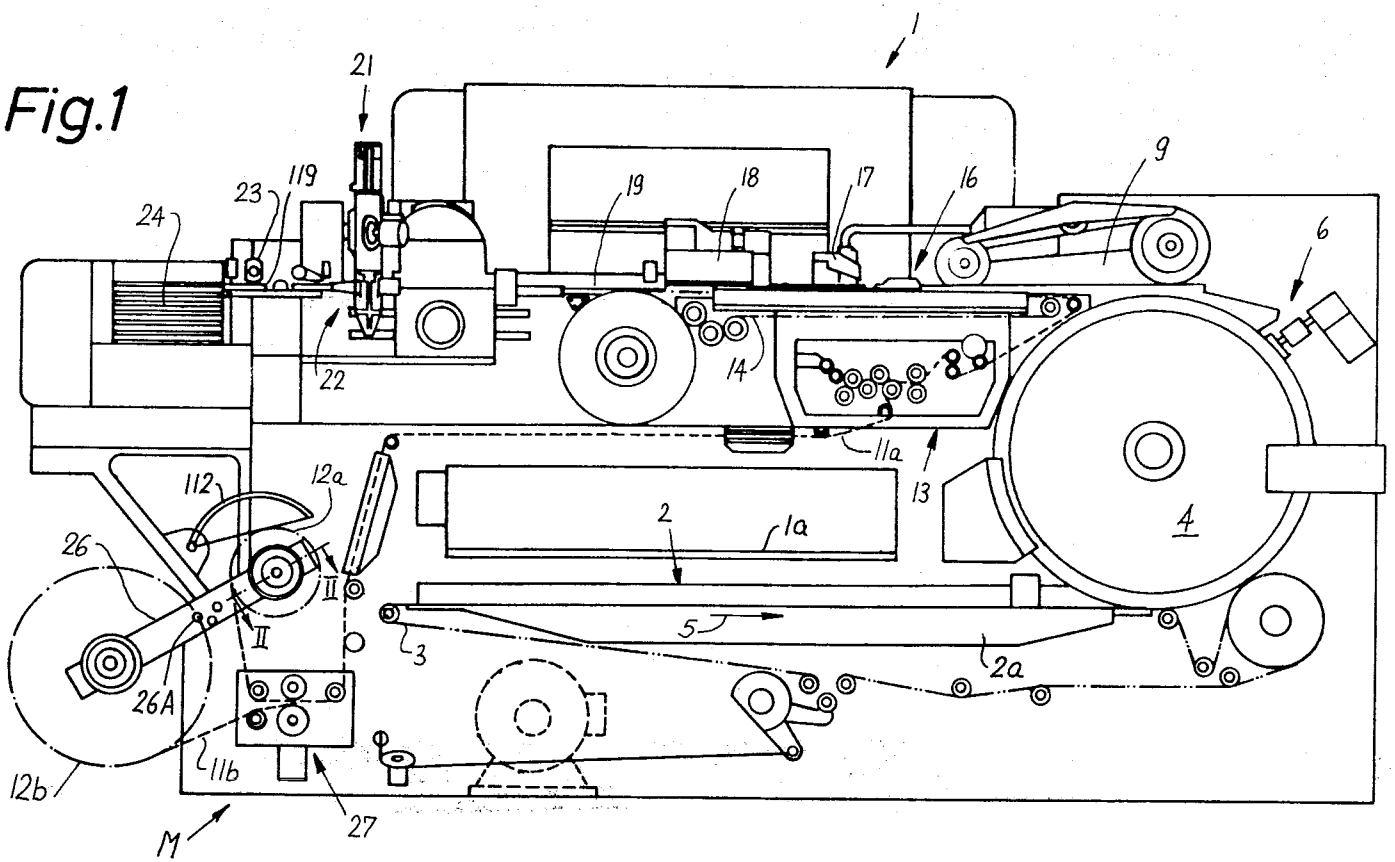
FIG. 1 is a schematic elevational view of a cigarette making machine with a carrier for two apparatus which embody the invention.

FIG. 1 shows a cigarette making machine of the type known as "Garant" produced by Hauni-Werke Körber & Co. KG., Hamburg, Federal Republic Germany. The machine comprises a distributor 1 which showers the leading edge of a relatively wide carpet of tobacco particles into an elongated channel 2. The distributor 1 comprises a wide apron 1*a* whose upper reach carries the carpet and advances in a direction toward the observer of FIG. 1.

The particles of tobacco which descend into the channel 2 are intercepted and advanced (see the arrow 5) by the upper reach of a foraminous belt conveyor 3. The upper reach of the conveyor 3 is adjacent to the upper side of the air-permeable bottom wall of the channel 2, and such bottom wall is located above a suction chamber 2*a* which insures that the particles of tobacco adhere to the upper side of the upper reach of the conveyor 3 or to each other. The tobacco stream which accumulates on and advances with the conveyor 3 is fully grown before it reaches the circumferential groove of a suction wheel 4. The groove has a foraminous bottom wall which surrounds a stationary suction chamber so that the stream adheres to the bottom wall and advances with the suction wheel 4 past a trimming or equalizing device 6 which removes the surplus so that the remaining major part of the stream forms a continuous rod-like tobacco filler. The filler is transferred onto a continuous cigarette paper web 11*a* which is drawn off a bobbin or reel 12*a* and passes through an imprinting mechanism 13 on its way toward the upper reach of an endless belt conveyor 14 known as garniture. The means for transferring the filler from the circumferential groove of the suction wheel 4 onto the paper web 11*a* on the upper reach of the garniture 14 comprises an endless band conveyor 9 which is permeable to air and whose lower reach travels below a stationary suction chamber. The imprinting mechanism 13 provides the web 11*a* with spaced-apart indicia denoting the name of the manufacturer, the trademark(s) of the manufacturer, the brand name of the cigarettes and/or other information.

The garniture 14 transports the web 11*a* and the rod-like tobacco filler through a wrapping mechanism 16 wherein the web is draped around the filler in such a way that one of its marginal portions extends upwardly and is coated with a film of adhesive by a paster 17. The adhesive-coated marginal portion is thereupon folded over the other marginal portion to convert the web 11*a* into a tube, and the resulting seam is heated or cooled by a sealer 18 (depending upon whether the adhesive is a wet adhesive or a hotmelt). The thus obtained continuous cigarette rod 19 is severed by a cutoff 21 to yield a single file of coaxial plain cigarettes 119 of desired length. Successive cigarettes 119 are propelled into successive flutes of a rotary drum-shaped row forming conveyor 24 by a rapidly rotating accelerating cam 23. The reference character 22 denotes a guide for the leader of the rod 19 at the severing station. The conveyor 24 transports one or more rows of cigarettes 119 sideways to a further processing station, e.g., to a filter tipping machine, into so-called chargers or trays, or directly into the magazine of a packing machine.

The reel 12*a* is mounted on a carrier 26 which is pivotable in the machine frame M, as at 26A, and further supports a fresh bobbin or reel 12*b* containing a supply of fresh cigarette paper web 11*b*. The leader of the web 11*b* is held in a position of readiness in a splicing device 27 which automatically attaches the leader of the web 11*b* to the running web 11*a* when the supply of wrapping material on the reel 12*a* is about to expire. A splicing device which can be used in the cigarette maker of FIG. 1 is disclosed in the commonly owned U.S. Pat. No. 3,730,811 granted May 1, 1973 to Gerd-Joachim Wendt. The reference character 112 denotes a detector which monitors the diameter of the expiring reel 12*a* and actuates the splicing mechanism 27 when the diameter of the reel 12*a* is reduced to a predetermined minimum value.

Figure 2:
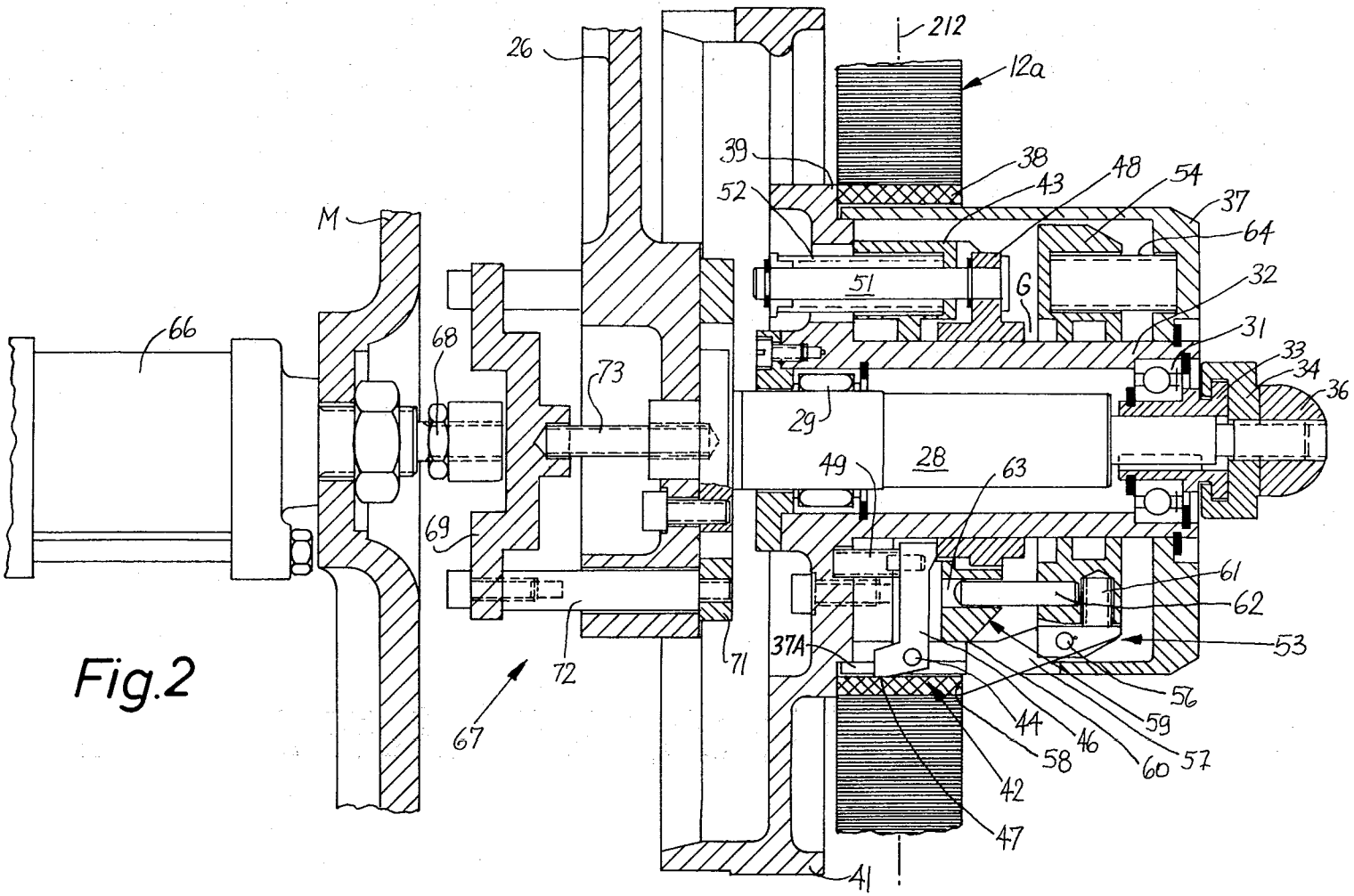
FIG. 2 is an enlarged sectional view substantially as seen in the direction of arrows from the line II—II of FIG. 1.

The manner in which the reel 12*a* is mounted on the carrier 26 is identical with the manner of mounting the reel 12*b*. FIG. 2 merely shows the mounting of the reel 12*a*. When the splicing of the leader of the fresh web 11*b* to the running web 11*a* is completed, the web 11*a* is automatically severed behind the splice so that the remnant of the reel 12*a* can be removed from the carrier 26. The latter is then pivoted at 26A to move the reel 12*b* to the position previously occupied by the reel 12*a*, and the attendant thereupon attaches a fresh reel to the carrier 26 and threads the leader of the web on such fresh reel into the splicing mechanism 27.

Referring now to FIG. 2, the carrier 26 has a shaft 28 which extends outwardly, i.e., toward the observer of FIG. 1. As mentioned above, the carrier 26 is turnable on the pivot 26A which is mounted in the frame M of the cigarette maker. The shaft 28 does not rotate with respect to the carrier 26. This shaft is surrounded by a roller bearing 29 and a ball bearing 31, and these bearings are surrounded by a rotatable sleeve-like holder 32. The ball bearing 31 is mounted on and is movable axially of the shaft 28 by a nipple 33 which, in turn, is movable axially by a nut 34 meshing with the shaft 28.

The nut 34 can be held in the selected axial position by a lock nut 36 which also meshes with the shaft 28. The nut 34 can shift the entire holder 32 to thus insure that the central planes 212 of relatively wide or relatively narrow webs will be held in a predetermined position. A reel which contains a supply of a relatively narrow web will be replaced with a reel for a wider web when the machine is to switch from the making of smaller-diameter cigarettes to the making of larger-diameter cigarettes.

The holder 32 is surrounded by and supports a hollow cylindrical spindle 37 for the annular core 38 of the reel 12*a*. The outer diameter of the spindle 37 is slightly smaller than the inner diameter of the core 38. Furthermore, the holder 32 comprises a radial flange 39 which provides an abutment or stop for the left-hand end face of the core 38, as viewed in FIG. 2. A portion of the flange 39 constitutes a braking drum 41.

The apparatus of FIG. 2 further comprises a first locating device 42 which serves to automatically center the core 38, as considered in the radial direction of the spindle 37. A second locating device 53 serves to maintain the core 38 in a predetermined axial position, namely, in abutment with the flange or stop 39.

The locating device 42 comprises a ring-shaped support 43 which is fixedly mounted on the holder 32 and carries six equally spaced two-armed levers or fingers 46. These levers are disposed in radial planes which include the axis of the shaft 28 and are turnable on pivot members 44 which are mounted in the support 43. The shorter arms 47 of the levers 46 include portions which can be expelled from the interior of the hollow spindle 37 to engage the internal surface of the core 38. The spindle 37 has apertures in the form of slots 37A (one shown in FIG. 2) through which the shorter arms 47 of the levers 46 can extend to engage the core 38. The means for pivoting the levers 46 in directions to move the shorter arms 47 against the internal surface of the core 38 comprises a ring-shaped actuating element 48 which causes the arms 47 to engage the core 38 when it moves in a direction to the left, as viewed in FIG. 2. The longer arms of the levers 46 are biased by resilient elements in the form of helical springs 49 which react against the flange 39 and tend to retract the shorter arms 47 into the interior of the spindle 37. The actuating element 48 is connected with three equally spaced posts 51 whose axes are parallel to the axis of the shaft 28 and which are reciprocable in the support 43. Helical springs 52 which surround the posts 51 react against the support 43 and tend to move the actuating element 48 in a direction to the left, as viewed in FIG. 2. Thus, the springs 52 tend to move the actuating element 48 to and to maintain the actuating element in a position in which the shorter arms 47 of the levers 46 engage and center the core 38.

The locating device 53 comprises a ring-shaped support 54 which surrounds and is reciprocable along the holder 32. The support 54 is provided with pivot members 56 for six equally spaced two-armed levers or fingers 57 each of which is disposed in a radial plane including the axis of the shaft 28. The longer arms of the levers 57 have projections 58 which can engage and bear against the adjacent end face of the core 38 to urge the other end face of the core against the flange 39. The longer arms of the levers 57 further comprise projections 60 which constitute followers and track the conical cam 59 of the support 43. The shorter arms of the levers 57 are biased by radially disposed helical springs 61 which react against the support 54. The latter is connected with three equally spaced guide pins 62 which are parallel to the shaft 28 and extend into holes 63 machined into the support 43. The support 54 is biased in a direction to the left, as viewed in FIG. 2, by three helical springs 64 which react against the radially inwardly extending collar of the spindle 37.

When the core 38 of the reel 12*a* is properly located on the spindle 37, the actuating element 48 is separated from the support 54 by an annular clearance or gap G. If the bias of the springs 52 equals the bias of the springs 64, the force with which the arms 47 of the levers or fingers 46 engage the internal surface of the core 38 greatly exceeds the force with which the projections 58 of the levers or fingers 57 engage the right-hand end face of the core. This will be readily appreciated since the springs 52 bias the longer arms of the levers 46 via element 48 whereas the springs 64 bias the support 54 against the shorter arms of the levers 57. In the illustrated embodiment, the force with which the levers 46 engage the core 38 is approximately three times the force which is applied by the levers 57. The axes of the pivot members 44 and 56 are normal to the axis of the shaft 28.

The actuating element 48 serves to shift the support 54 axially and to thereby retract the longer arms of the levers 57 into the interior of the spindle 37. In order to effect such movement of the support 54, the actuating element 48 must be moved in a direction to the right (i.e., against the opposition of the springs 52) by a motor 66 here shown as a pneumatic cylinder and piston unit which is mounted on the frame M and whose piston rod carries an axially adjustable nut 68 for shifting the posts 51 (and hence the actuating element 48) against the opposition of the springs 52 by way of a motion transmitting unit or coupling 67. The unit 67 is axially movably installed in the carrier 26 and comprises a plate 69 which can be shifted in a direction to the right, as viewed in FIG. 2, when the motor 66 is operated to move the nut 68 in the same direction. The unit 67 further comprises a ring 71 which is adjacent to the left-hand end faces of the posts 51 and is coupled to the plate 69 by several equidistant bolts 72 slidable in complementary bores of the carrier 26. A helical spring 73 reacts against the carrier 26 and bears against the plate 69 so as to maintain the plate in abutment with or close to the nut 68, i.e., to normally maintain the unit 67 in the inoperative or idle position of FIG. 2 in which the ring 71 is spaced apart from the posts 51. The plate 69 is adjacent to the motor 66 when the bobbin or reel 12*a* of FIG. 2 is moved to the position occupied by bobbin 12*b* of FIG. 1, i.e., when the bobbin 12*a* is about to be removed from the spindle 37 and replaced with a fresh bobbin.

The motor 66, the unit 67 and the actuating element 48 constitute a control means which insures that the locating device 53 engages a core 38 on the spindle 37 ahead of the locating device 42.

The operation of the apparatus of FIG. 2 is as follows.

The annular core 38 is properly mounted on the spindle 37 and is caused to bear against the flange 39. Furthermore, the shorter arms 47 of the levers 46 engage the internal surface of the core 38 so that the reel 12*a* is properly centered on the spindle 37. When the supply of web 11*a* on the core 38 is nearly exhausted, the splicing device 27 is actuated by the detector 112 of FIG. 1 to connect the leader of the fresh web 11*b* to the web 11*a* and to sever the web 11*a* behind the splice. Thus, the remnant of the practically expired reel 12*a* is ready to be removed from the spindle 37. The attendant actuates the motor 66 to move the piston rod and its nut 68 in a direction to the right, as viewed in FIG. 2. The motor 66 can be actuated by depressing a knob or by closing a switch, not shown, on the control panel of the cigarette maker or at a location adjacent to the carrier 26. Furthermore, the motor 66 can be started in automatic response to pivoting of the carrier 26 about the axis of the pivot 26A so as to move the reel 12*b* to the position previously occupied by the reel 12*a*. In fact, the operation can be automated still further by causing the carrier 26 to automatically pivot on the member 26A as soon as the splicing operation is completed.

As the nut 68 moves away from the cylinder of the motor 66, it pushes the plate 69 in the same direction and the bolts 72 transmit such motion to the ring 71 which depresses the posts 51 and thereby stresses the springs 52. The spring 73 also stores energy as a result of movement of the plate 69 toward the carrier 26. The posts 51 move the actuating element 48 in a direction to the right whereby the springs 49 are free to dissipate energy and to pivot the levers 46 of the locating device 42 in directions to disengage the arms 47 from the internal surface of the core 38 on the spindle 37, i.e., the levers 46 are retracted into the interior of the spindle 37. Thus, the engagement between the core 38 and the parts of the locating device 42 is terminated.

The nut 68 continues to move toward the carrier 26 and causes the actuating element 48 to engage and shift the support 54 of the locating device 53. The support 54 stresses the springs 64 and moves its levers 57 with respect to the support 43 for the levers 46 (which are already retracted into the interior of the spindle 37). The followers 60 of the levers 57 slide along the cam 59 of the support 43 and enable the springs 61 to dissipate energy whereby the levers 57 pivot in directions to retract their projections 58 into the interior of the spindle 37, i.e., the projections 58 are disengaged from the adjacent end face of the core 38. The attendant then slips the core 38 off the spindle 37 and replaces such core with the annular core of a fresh reel (not shown) which is pushed toward the flange 39. In the next step, the attendant arrests or deactivates the motor 66 so as to permit the spring 73 to expand and to return the motion transmitting unit 67 to the illustrated position. The springs 64 are free to expand and push the support 54 of the locating device 53 toward the carrier 26. At the same time, the springs 52 begin to return the actuating element 48 to the position of FIG. 2. During the first stage of such return movement of axially movable parts, the springs 64 cause the levers 57 of the locating device 52 to move their projections 58 outwardly and into engagement with the end face of the core 38 of the fresh reel. The projections 58 then urge the left-hand end face of the core against the flange 39, i.e., the fresh reel is properly located as considered in the axial direction of the shaft 28. The magnitude of the force with which the levers 57 engage and hold the end face of the core is determined by the springs 64. The actuating element 48 thereupon pivots the levers 46 against the opposition of the springs 49 and causes the shorter arms 47 of these levers to engage the internal surface of the core. The force with which the levers 46 engage and center the core exceeds the force which is applied by the levers 57, i.e., the centering action in the radial direction can be carried out after the axial adjustment of the position of the core by means of the levers 57 is already completed.

An important advantage of the improved apparatus is that the subdivision of locating means into a locating device 53 for axial positioning of the core 38 and into a locating device 42 for radial positioning of the core insures accurate mounting of successive bobbins with a high degree of reproducibility. Furthermore, such subdivision of locating means renders it possible to select an optimum bias for each locating device, i.e., the force with which the "radial" locating device 42 engages the internal surface of the core 38 can be selected independently of the force with which the core is engaged by the "axial" locating device 53. Such separation of forces is desirable in order to conform the clamping action to the prevailing circumstances, primarily to the nature and dimensions of the bobbin and the web material thereon.

Another important advantage of the improved apparatus is that a bobbin can be rapidly released in spite of the fact that it is normally held and biased by two discrete locating devices. This is due to the fact that the levers or fingers of the two locating devices are retractible into the interior of the apertured spindle 37 by the simple expedient of operating the motor 66 in order to move the actuating element 48 of the control means toward and to displace the support 54 for the locating device 53. Return movement of the levers 46 and 57 into the positions of engagement with the core of a fresh bobbin takes place automatically under the action of the biasing means 52, 64 as soon as the motor 66 is arrested or otherwise operated in a manner to withdraw the piston rod and the nut 68 or to permit the spring 73 to dissipate energy and thereby return the parts 69, 71, 72 of the motion transmitting unit 67 to the positions shown in FIG. 2.

A further important advantage of the improved apparatus is that the levers (57) which engage the core 38 with a lesser force are moved to their operative positions ahead of the levers 46 which engage the core with a greater force. Thus, the levers 46 can properly center the core 38 on the spindle 37 in spite of the fact that, at the time of such centering, the levers 57 already assume their operative positions and urge the core against the flange 39.

An additional advantage of the apparatus is that it can properly engage and locate cores of analogous annular articles of different axial lengths. This will be readily understood since, when the actuating element 48 is caused to move the support 54 axially of the shaft 28 and against the opposition of the springs 64, the levers 57 can be retracted to such positions that they can engage a relatively long or a relatively short cylindrical core when the actuating element 48 begins to move toward the support 43 in response to dissipation of energy by the springs 52. In other words, the improved apparatus is sufficiently versatile to accept bobbins for wide or narrow webs. Furthermore, and since the device 42 serves exclusively for centering of a core on the spindle 37, and since (in the illustrated embodiment) the levers 46 can displace the core even though the latter is already biased by the levers 57 to bear against the flange 39, the apparatus can properly position bobbins with cores having inner diameters which match, closely approximate or deviate substantially from the outer diameter of the spindle 37.

The feature that the locating means 53 comprises a reciprocable support 54 which is biased by several springs 64 and that the levers 57 slide along the cam 59 of the stationary support 43 insures that each and every lever 57 engages the adjacent end face of the core 38 with the same force. This also applies for the levers 46, i.e., these levers apply to the internal surface of the core identical forces because they are biased against the core by the springs 52 via actuating element 48 which engages the longer inner arms of the levers 46 when it moves in response to bias of the springs 52. The feature that the actuating element 48 can shift the support 54 while moving in one direction and can pivot the levers 46 while moving in the opposite direction brings about savings in space and contributes to simplicity of the apparatus.

The core 38 can be removed from the spindle 37 while the cigarette maker continues to turn out rod-shaped articles. Thus, all an attendant has to do is to move the motion transmitting unit 67 into a position of register with the motor 66 and to actuate the motor in order to move the element 48 in a direction to the right, as viewed in FIG. 2. A single motor 66 suffices for both apparatus which are mounted on the carrier 26 because an exhausted bobbin is normally removed after it assumes the position previously occupied by the fresh bobbin **12*b* of FIG. 1. The motion transmitting unit 67 serves the purpose of moving the actuating element 48 only in a direction to retract the levers 46 and 57 into the spindle; the movement of the actuating element 48 in the opposite direction is effected by the springs 52**.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed is:

1. Apparatus for releasably clamping an annular article, particularly the cylindrical core of a bobbin of web material, comprising a holder; a rotary spindle mounted on said holder and arranged to extend through the article thereon; a stop extending radially beyond said spindle to constitute an abutment for one end of the article; first locating means provided on said holder and movable to and from a position of engagement with the other end of the article on said spindle; second locating means provided in said spindle and movable to and from a position of engagement with the internal surface of the article on said spindle; biasing means including means for urging one of said locating means against the article on said spindle with a first force when said one locating means assumes said position thereof and for urging the other of said locating means against the article with a greater second force when said other locating means assumes said position thereof; and control means including actuating means operative to effect the movement of said one locating means to the respective position ahead of said other locating means.

2. Apparatus as defined in claim 1, wherein at least one of said locating means comprises a plurality of fingers movable to and from engagement with the article on said spindle and disposed in planes including the axis of said spindle.

3. Apparatus as defined in claim 1, further comprising means for yieldably opposing the movements of said locating means to said positions under the action of said biasing means.

4. Apparatus as defined in claim 1, wherein said spindle has apertures and said second locating means comprises a plurality of fingers movable through the apertures of said spindle into and from engagement with the internal surface of an article on said spindle, and a support fixed to said holder and movably supporting said fingers.

5. Apparatus as defined in claim 4, wherein said first locating means comprises a plurality of additional fingers movable through the apertures of said spindle into and from engagement with the other end of the article on said spindle and an additional support for said additional fingers, said additional support being movable with respect to said holder in the axial direction of said spindle.

6. Apparatus as defined in claim 5, wherein said first mentioned support includes a cam and said additional fingers include followers tracking said cam during movement of said additional support with respect to said holder.

7. Apparatus as defined in claim 5, wherein said biasing means includes resilient means bearing against said additional support.

8. Apparatus as defined in claim 5, wherein said biasing means includes resilient means arranged to bias said first mentioned fingers against the article on said spindle by way of said actuating means.

9. Apparatus as defined in claim 8, wherein said actuating means comprising an element which is reciprocable with respect to said holder in the axial direction of said spindle.

10. Apparatus as defined in claim 5, wherein said actuating means includes an element which is disposed between said supports and is movable axially of said spindle, said control means further comprising means for moving said element axially of said spindle.

11. Apparatus as defined in claim 10, wherein said biasing means includes first resilient means for urging said first mentioned fingers against the internal surface of the article on said spindle by way of said element whereby said element is biased in a direction toward said first mentioned support, and second resilient means for urging said additional support toward said first mentioned support, said moving means including means for moving said element against the opposition of said first and thereupon against the opposition of said second resilient means.

12. Apparatus as defined in claim 11, wherein said element is spaced apart from said additional support when said first mentioned and said additional fingers engage the article on said spindle.

13. Apparatus as defined in claim 10, further comprising a pivotable carrier for said support, said moving means including a motor adjacent to said carrier.

14. Apparatus as defined in claim 13, wherein said control means further comprises motion transmitting means interposed between said motor and said element, said motor including means for moving said element via said motion transmitting means axially of said spindle in a direction to effect disengagement of all of said fingers from the article on said spindle.

15. Apparatus as defined in claim 14, wherein said motion transmitting means is reciprocable on said carrier into and from motion transmitting engagement with said element and further comprising means for yieldably opposing the movement of said motion transmitting means into engagement with said element.

16. Apparatus as defined in claim 1, wherein said biasing means comprises springs.

* * * * *